US011572759B2

(12) United States Patent
Osborne et al.

(10) Patent No.: US 11,572,759 B2
(45) Date of Patent: Feb. 7, 2023

(54) DISTRIBUTED ACOUSTIC SENSOR WITH TRACKABLE PLUG

(71) Applicant: HALLIBURTON ENERGY SERVICES, INC., Houston, TX (US)

(72) Inventors: Paul M. Osborne, Denver, CO (US); Francis Joel Pereira, Tomball, TX (US); Dale Frank Hopwood, Thornton, CO (US); John Singh, Kingwood, TX (US); Paul Meier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 703 days.

(21) Appl. No.: 16/530,465

(22) Filed: Aug. 2, 2019

(65) Prior Publication Data

US 2021/0032957 A1 Feb. 4, 2021

(51) Int. Cl.

| | |
|---|---|
| ***E21B 33/16*** | (2006.01) |
| ***E21B 47/16*** | (2006.01) |
| ***E21B 47/135*** | (2012.01) |

(52) U.S. Cl.

CPC ..... *E21B 33/16* (2013.01); *E21B 47/135* (2020.05); *E21B 47/16* (2013.01)

(58) Field of Classification Search

None

See application file for complete search history.

(56) References Cited

U.S. PATENT DOCUMENTS

| | | | | |
|---|---|---|---|---|
| 6,401,814 | B1 * | 6/2002 | Owens | E21B 47/095 166/250.14 |
| 6,634,425 | B2 | 10/2003 | King et al. | |
| 9,222,349 | B2 | 12/2015 | Leblanc | |
| 9,222,828 | B2 * | 12/2015 | Fripp | E21B 47/005 |
| 2002/0157828 | A1 | 10/2002 | King et al. | |
| 2008/0272931 | A1 | 11/2008 | Auzerais et al. | |
| 2013/0298665 | A1 | 11/2013 | Minchau | |
| 2014/0034301 | A1 * | 2/2014 | Leblanc | E21B 33/16 166/250.14 |
| 2014/0180592 | A1 * | 6/2014 | Ravi | E21B 47/107 702/11 |

(Continued)

FOREIGN PATENT DOCUMENTS

| | | | |
|---|---|---|---|
| RU | 175594 | U1 | 12/2017 |
| SU | 280389 | A1 | 9/1970 |

OTHER PUBLICATIONS

Liokumovich et al. Fundamentals of Optical Fiber Sensing Schemes Based on Coherent Optical Time Domain Reflectometry: Signals Model Under Static Fiber Conditions, 2015, IEEE (Year: 2015).*

(Continued)

*Primary Examiner* — Curtis A Kuntz

*Assistant Examiner* — Jerold B Murphy

(74) *Attorney, Agent, or Firm* — Kilpatrick Townsend & Stockton LLP

(57) ABSTRACT

A downhole well system can use a fiber optic cable that can be positioned downhole along a length of a wellbore. The well system may include a top plug, a bottom plug, or both that are used to contain a cement slurry during a cementing operation. The movement of the top plug and bottom plug may cause acoustic noise along the downhole portion of the casing. A reflectometer may detect the acoustic noise from strain in the fiber optic cable and determine a location of the top plug or bottom plug downhole.

19 Claims, 5 Drawing Sheets

(56) References Cited

U.S. PATENT DOCUMENTS

| | | | | |
|---|---|---|---|---|
| 2018/0245424 | A1 | 8/2018 | Stokley et al. | |
| 2018/0313206 | A1* | 11/2018 | Dirksen | E21B 33/16 |
| 2018/0320503 | A1 | 11/2018 | Smith et al. | |

OTHER PUBLICATIONS

Lu et al. Coherent optical time domain reflectometry using three frequency multiplexing probe, 2012, Elsevier Ltd (Year: 2012).*
PCT/US2019/044905 , "International Search Report and Written Opinion", dated Apr. 28, 2020, 14 pages.
RU Application No. RU2021138600, "Office Action", dated Aug. 3, 2022, 9 pages.

* cited by examiner

DISTRIBUTED ACOUSTIC SENSOR WITH TRACKABLE PLUG

TECHNICAL FIELD

The present disclosure relates generally to using distributed acoustic sensors in downhole wellbore operations. More particularly, the present disclosure relates to a system that can track plugs used in a downhole cementing operation using distributed acoustic sensors.

BACKGROUND

A well system (e.g., oil or gas) may include a wellbore drilled through a subterranean formation. The subterranean formation may include a rock matrix permeated by oil or gas that is to be extracted using the well system. For surety of access during a production phase, cementing operations may be conducted during drilling to provide stability of the well structure. A cementing operation generally includes pumping cement into the well system using a one or two plug system. The one or two plug system may be implemented while pumping the cement to prevent contamination of the cement by wellbore fluids. Another important function of a top plug (e.g., a top plug in either a one or two plug configuration) is to indicate to the surface that the cementing operation has been completed.

Determining when the top plug has landed on a top collar within a wellbore may be measured by a positive pressure increase in the cement pumping. However, during cement pumping, the top plug may not land at the expected time if a leak of displacement fluid around the top plug causes the top plug to move at a slower than expected rate. Additionally, if a leak develops around the top plug, an increase of pressure may not be experienced as the displacement fluid leaks around the top plug allowing some pressure to be relieved. This may result in inaccurate measurements of a location of the top plug within the wellbore. Additional variables that can cause the top plug to not reach the planned landing location are: compressible fluids in the wellbore and or used for displacement, incorrect volume calculation, inefficient surface pumps, or loss of integrity of the casing.

DETAILED DESCRIPTION

Certain aspects and features relate to distributed acoustic sensors and detecting a location of a downhole plug within a wellbore. In particular, the downhole plug may be located within a wellbore using a distributed acoustic sensor while the downhole plug is pumped into the wellbore.

Certain aspects and features provide methods of tracking a downhole plug. For example, a downhole well system may include a fiber optic cable that can be attached or otherwise positioned downhole along a length of a wellbore. The well system may include a top plug, a bottom plug, or both that are used to contain a cement slurry during a cementing operation. In one example, the bottom plug may be inserted into the wellbore casing and then a cement slurry can be pumped uphole from the bottom plug. The top plug may be inserted into the wellbore casing uphole from the cement slurry. A displacement fluid can be pumped into the wellbore casing uphole from the top plug to displace the top plug, cement slurry, and bottom plug down the wellbore. The movement of the top plug and bottom plug may cause acoustic noise along the downhole portion of the casing. A reflectometer may detect the acoustic noise from strain in the fiber optic cable and determine a location of the top plug or bottom plug downhole.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
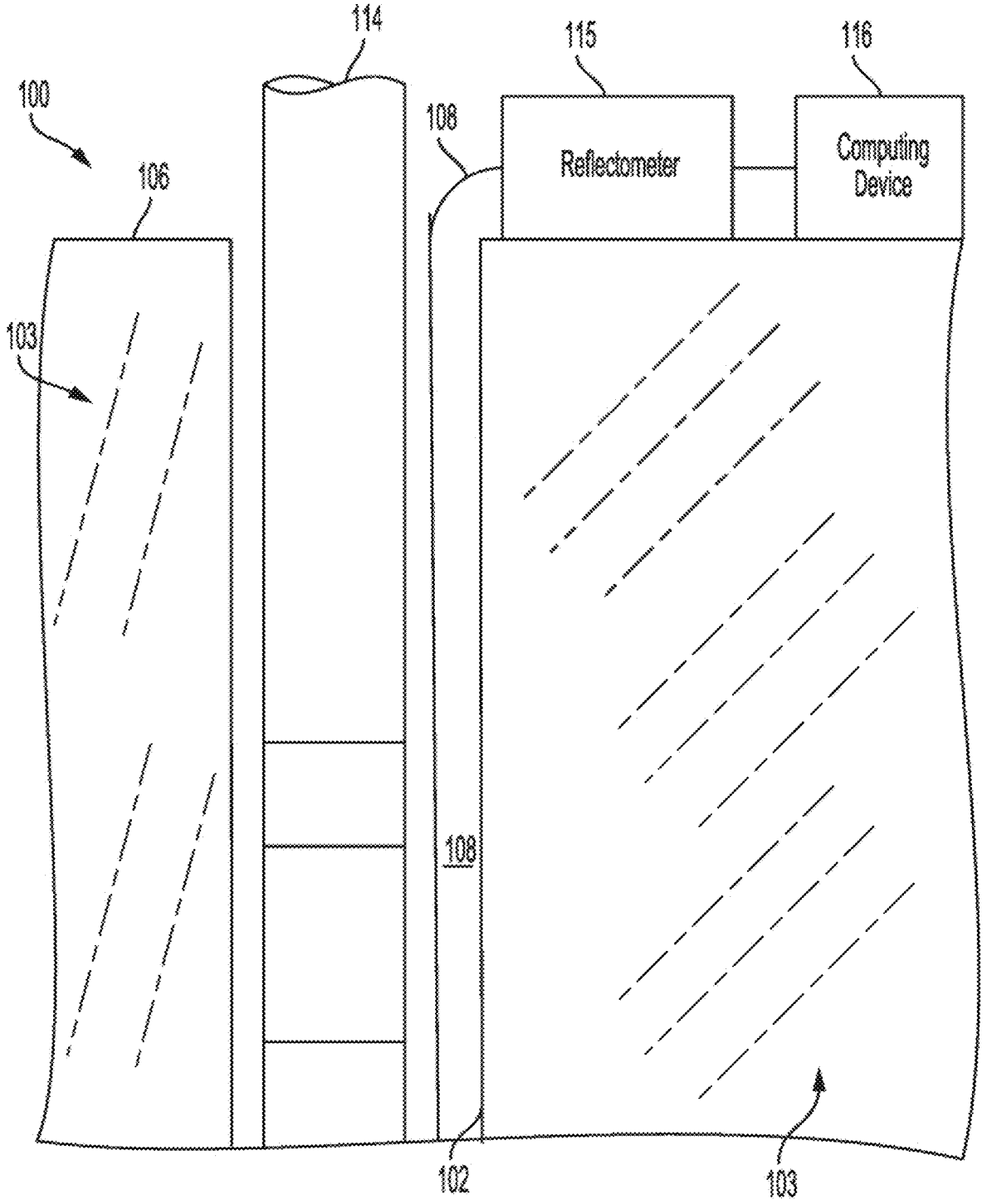
FIG. 1 is a schematic view of a well system according to some aspects of the disclosure.

FIG. 1 schematically illustrates an example of a well system 100 that includes capability for measuring acoustic characteristics within a wellbore 102 according to some aspects of the disclosure. The wellbore 102 may be created by drilling into a formation 103 (e.g., a hydrocarbon bearing formation). For surety of access during a production phase of the well system 100, cementing operations may be conducted during drilling of the wellbore 102 to provide stability of the well structure. A cementing operation generally includes pumping cement into the well system using a one or two plug system, as described below with respect to FIG. 3. The one or two plug system may be implemented while pumping the cement to prevent contamination of the cement by wellbore fluids.

The well system 100 illustrates a length of fiber optic cable 108. As illustrated, the fiber optic cable 108 may be communicatively coupled to a reflectometer 115. In operation, the fiber optic cable 108 and the reflectometer 115 may be used to perform distributed acoustic sensor operations within the wellbore 102. For example, the fiber optic cable 108 and the reflectometer 115 may both be part of a distributed acoustic sensor (e.g., the reflectometer 115 may inject optical signals into the fiber optic cable 108 and detect variations in a reflection signal received from the fiber optic cable 108).

The fiber optic cable 108 may be attached to an outer surface of a casing 114, or the fiber optic cable 108 may be suspended from a surface 106 of the wellbore 102 between the casing 114 and a wall of the wellbore 102 or inside the casing. The reflectometer may be communicatively coupled to a computing device 116. The reflectometer 115, the computing device 116, or both may be positioned at a surface 106 of the well system 100. In some examples, the reflectometer 115 may be a coherent optical time-domain reflectometer. A coherent optical time-domain reflectometer may provide sufficient sensitivity for the distributed acoustic sensor using the fiber optic cable 108. The coherent optical time-domain reflectometer may use light with coherent lengths. The coherent optical time-domain reflectometer may detect acoustic events near the fiber (e.g., vibration of the casing, movement of a plug, etc.) that affects the phase of the backscattered centers. The coherent optical time-domain reflectometer may compute a location of the acoustic event using a phase difference resulting from the acoustic event.

In one example, the computing device 116 may be a computing device with a data acquisition system that can receive the output from the reflectometer 115 and process the output using various analysis and visualization tools. The computing device 116 may include a processor and a non-transitory computer-readable medium that includes instructions that are executable by the processor to perform various operations herein with regard to FIGS. 1-5.

Figure 2:
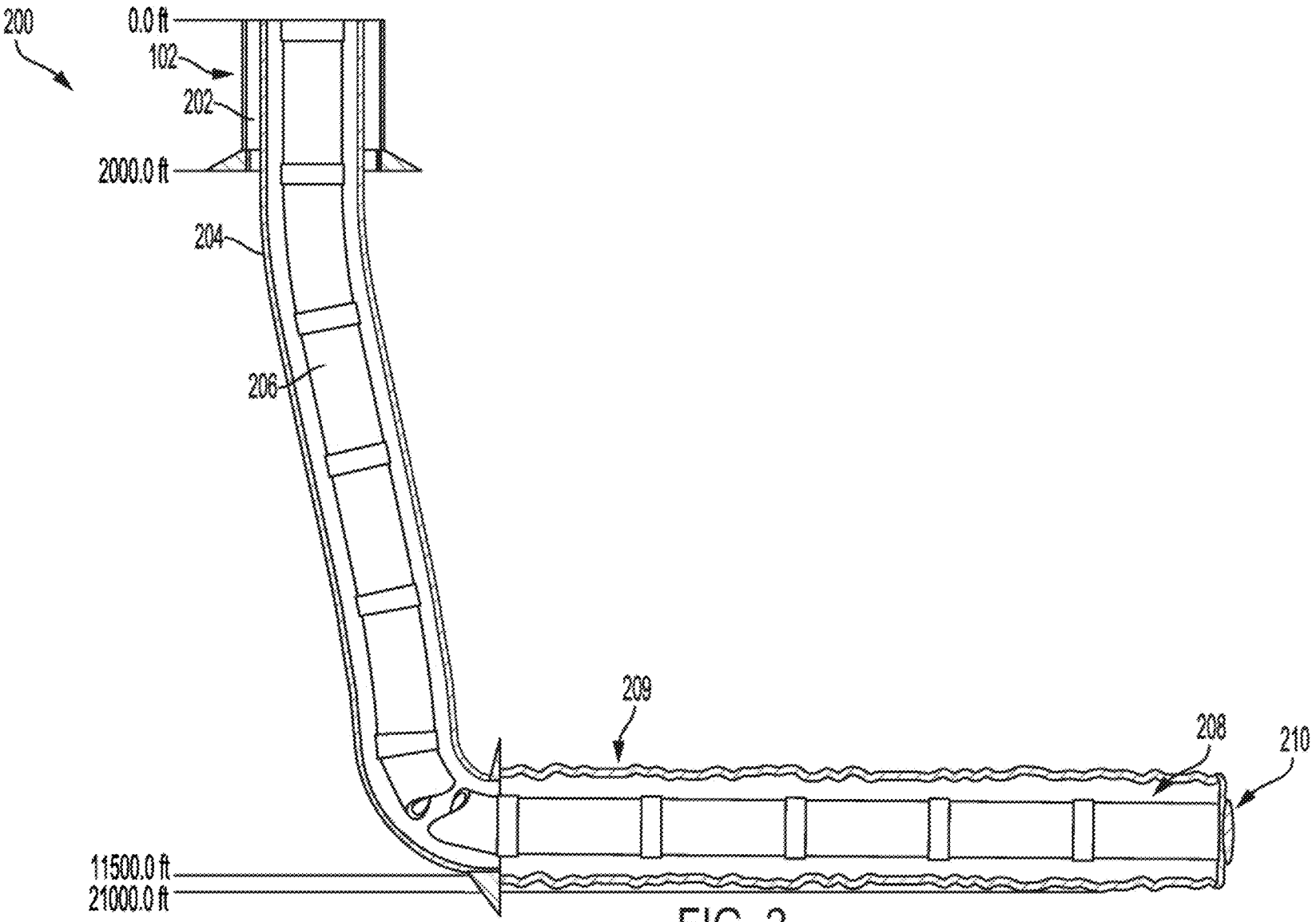
FIG. 2 is a schematic view of a well that includes multiple sections of casing according to some aspects of the disclosure.

FIG. 2 illustrates an example of a well system 200 that includes multiple sections of a well casing along the wellbore 102, according to some aspects of the disclosure. The well system 200 may include a first section of casing 202, a previous casing 204, and a production casing 206. As illustrated by FIG. 2, the production casing 206 may have a horizontal portion, while in other configurations, the production casing 206 may include only a vertical portion. At a furthest downhole portion of the production casing 206, the wellbore 102 contains an annulus 208 between a wall 209 of the wellbore 102 and the production casing 206. Fluids, including cement, flow out through a shoe 210 and into the annulus 208 surrounding the furthest downhole portion of the production casing 206. An example of a shoe 210 may be a short heavy steel collar assembly that is attached to the bottom of a casing string.

Figure 3:
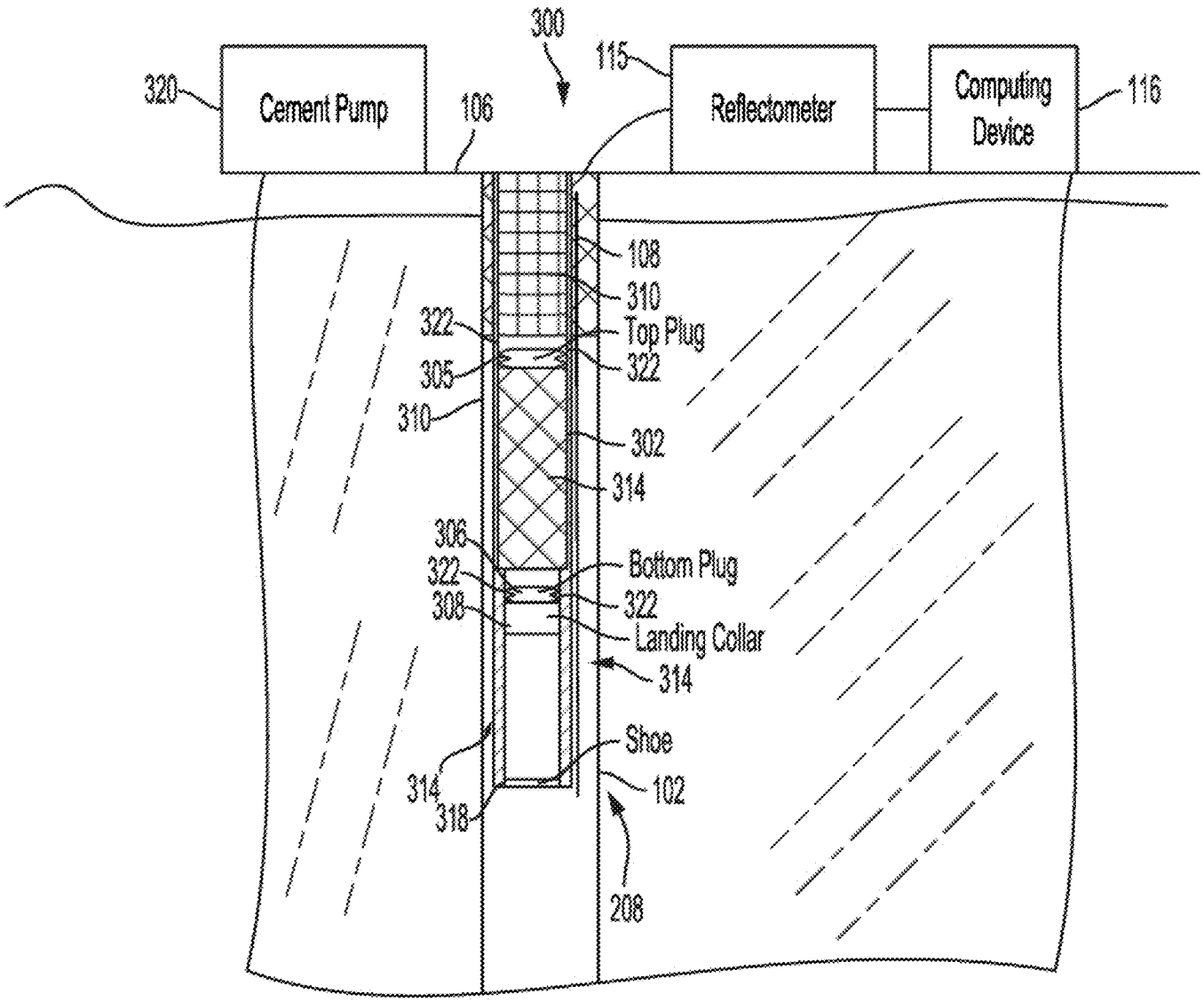
FIG. 3 depicts an exemplary well including a completion section of casing and a distributed acoustic sensor according to certain aspects of the disclosure.

FIG. 3 depicts an example of a well system 300 including a completion section of casing and a distributed acoustic sensor according to certain aspects of the disclosure. As illustrated in FIG. 3, a well system 300 may include a two plug configuration during a cementing process. In one aspect, the well system 300 includes a completion section of a casing 302 within a wellbore 102. As illustrated in FIG. 3, a cementing operation is being conducted on the completion section of the casing 302.

A cement pump 320 at the surface 106 may pump cement slurry 314 through the completion section of the casing 302. The cement pump 320 may pump a desired amount of cement slurry 314 into the casing 302 uphole from a bottom plug 306. A top plug 305 may then be positioned uphole from the cement slurry 314. Upon deployment of the top plug 305, the cement slurry 314, and the bottom plug 306, displacement fluid 310 is pumped by the cement pump 320, or other dedicated displacement fluid pump, into the casing uphole from the top plug 305 to provide a downhole force on the top plug 305, the cement, and the bottom plug 306, until the bottom plug 306 is seated on a landing collar 308. As illustrated in FIG. 3, the cement pump 320 has pumped enough displacement fluid into the casing 302 to seat the bottom plug 306 adjacent to the landing collar 308. The bottom plug 306 may have a rupturable seal that enables the cement slurry 314 to flow in a downhole direction after the bottom plug 306 is seated within the landing collar 308. The cement slurry 314 may flow through the landing collar 308, out of the shoe 318 and into an annulus 208 between the completion section of the casing 302 and the wellbore 102.

Still referring to FIG. 3, during the cementing operation, the cement pump 320 provides cement slurry 314 between the bottom plug 306 and the top plug 305. In one aspect, after the top plug 305 is installed within the wellbore casing 102 uphole from the cement slurry 314, the top plug 305 may move through the completion section of the casing 302 from an initial position to a final position adjacent to the bottom plug 306. While the top plug 305 is in motion, the reflectometer 115 may detect an acoustic signature along completion section of the casing 302 by detecting phase differences in fiber optic cable 108. In some aspects, the top plug 305 and or bottom plug 306 may be designed such that chevron shaped fins 322 of the plug 305 or 306 scrape the inside of the completion section of the casing 302. The fin design may provide a cleaning mechanism within the completion section of the casing 302 while the plugs 305 and 306 are run into the wellbore 102 to clean the wellbore 102 of any residual mud.

The scraping of the fins along the completion section of the casing 302 generates localized strain at and around the point of contact between the fins and completion section of the casing 302. In some aspects, the localized strain may be small in magnitude, however, the localized strain may be large enough to cause phase differences in the fiber optic cable 108 that are detected by the reflectometer 115. The reflectometer 115 may compute a location of the top plug 305 based on phase differences detected along the fiber optic cable 108. In another aspect, the reflectometer may detect a location of the top plug 305 or the bottom plug 306 in a condition where the bottom plug 306 is not seated to the landing collar 308. In some cases, the displacement fluid may be pumped uphole from the top plug 305 to displace the top plug 305 from an initial position to a final position. In one example, the final position of the top plug 305 may be adjacent to the bottom plug 306.

In some cases, the top plug 305 may not move along at the same rate as with the displacement fluid 310 and may travel at a lower rate than the pumping velocity. The top plug 305 may not travel at the same rate as the displacement fluid 310 in a situation that involves some amount of leak of displacement fluid 310 in or around the top plug 305 or a freefall of the top plug 306. A freefall of the top plug 305 may be caused by a condition of the casing 302 whereby the hydrostatic difference between the casing 302 and annulus 208 causes the top plug 305 to travel at a faster or slower speed than the pump velocity. The reflectometer 115 may monitor the phase differences in the fiber optic cable 108 to provide real-time tracking information to determine the rate, current location, and any stoppages experienced by the top plug 305 or the bottom plug 306 in a configuration that tracks both top and bottom plugs.

In some examples, multiple fiber optic cables may be placed at separate azimuthal positions around the completion section of the casing 302. In a multi-fiber optic configuration, each fiber optic cable may detect phase differences caused by strain in the completion section of the casing 302. In the example illustrated in FIG. 3, the completion section of the casing 302 may be coupled to a single fiber optic cable 108, however, other configurations are possible.

While various examples and embodiments have been described with reference to a "top plug" and "bottom plug" for purposes of explanation, it should be appreciated that a similar configuration could be used to track other objects that generate a detectable signature by the distributed acoustic sensor. Similar techniques to detect other objects within the wellbore (e.g., darts, balls, etc.) are within the teachings of the present disclosure.

Figure 4:
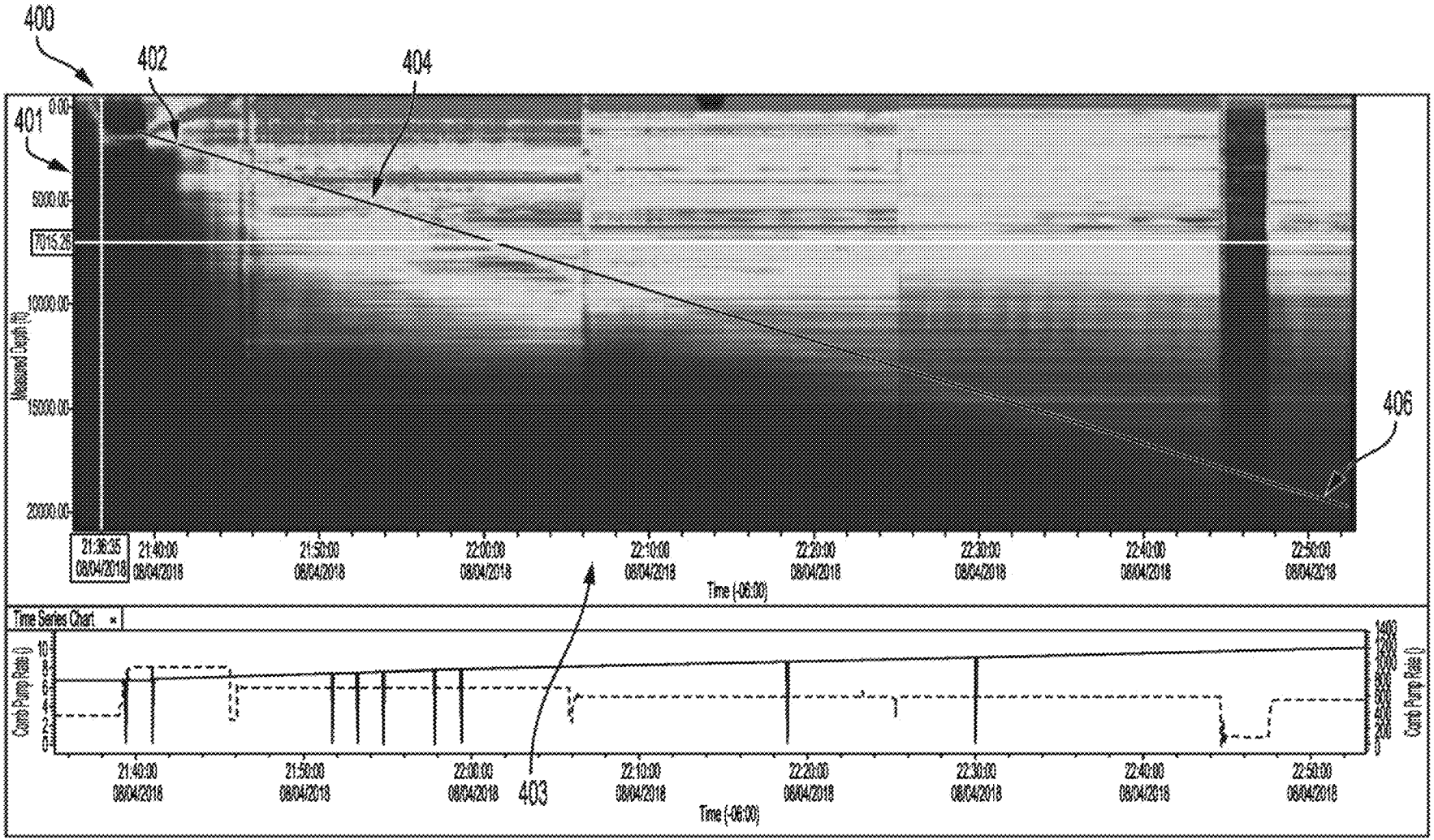
FIG. 4 depicts a plot of an output from the reflectometer according to some aspect of the disclosure.

FIG. 4 depicts an example of an output 400 of reflectometer according to some aspects of the disclosure. As illustrated by FIG. 4, the output 400 of the distributed acoustic sensors may be a plot of intensity of acoustic vibrations over time 403 along a length 401 of the wellbore 102. In one aspect, the output 400 (e.g., report/visualization) of the distributed acoustic sensor represents an intensity of an acoustic signature. In the particular example of FIG. 4, the output of the distributed acoustic sensors indicate the intensity of the localized strain that may be caused by movement of the top plug from the initial position to a final position. The intensity of the localized strain may be represented by a gray scale value (e.g., a higher value may be white, a lower value may be black) or a color value on a chart (e.g., a higher value may be red, a lower value may be blue). As illustrated in FIG. 4, a location of the top plug 305 can be represented by a curvilinear track 404. The track 404 may be a real-time representation of the position of the top plug 305. In the particular example illustrated by FIG. 4, the top plug 305 moves without any delay or stoppages. In some aspects, the top plug 305 may stop at a position adjacent to the bottom plug 306. In other aspects, the top plug 305 may stop or slow down at an intermediate position between an initial position 402 and a final position 406. In some conditions, when the top plug 305 is stationary, there will be an ambient level of noise within the well and no localized strain to detect. In other conditions, the top plug may be stopped at positions other than the final position 406 as determined by the particular configuration, as understood by one of skill in the art. Various intermediate values for localized strains may be represented along track 404 by intermediate color or brightness values (e.g., yellow or gray).

While the detection of localized strain is explained using acoustic signatures based on a physical contact between a portion of a plug (e.g., a fin) and the casing, it should be appreciated that detection by the distributed acoustic sensor is also possible in alternative configurations. For example, changes in fluid pressure within the casing 302 may be detected by the distributed acoustic sensor and a location of the plug within the casing determined. In this example, a localized strain along the casing 302 is being detected, but the localized strain may be caused by changes in fluid pressure rather than a physical contact between the plug and the casing 302. In another example, movement of a plug or other object within the casing 302 may cause a temperature change within the casing 302. In this example, the distributed acoustic sensor may detect the location of the plug by using a portion of the output 400 (e.g., low frequency data). Other configurations that cause various other types of localized strain on the casing (e.g., pressure, temperature, etc.) are possible without departing from the present disclosure.

The output of the distributed acoustic sensors in real-time enables detection of abnormal conditions of the cementing operation and correction of the abnormal condition during the cementing process. The improvement relieves the engineering crew from having to dead reckon a position of the top plug 305 or estimate a completion time. This enables a more competent cementing operation and more accurate indication of when the cementing operation is complete, or when remedial action is required to correct an issue. The real-time location of the top plug 305 eliminates uncertainty about the progress and status of the cementing operation. In an example, the output 400 of the distributed acoustic sensor may track both the top plug 305 and the bottom plug 306 at the same time.

Figure 5:
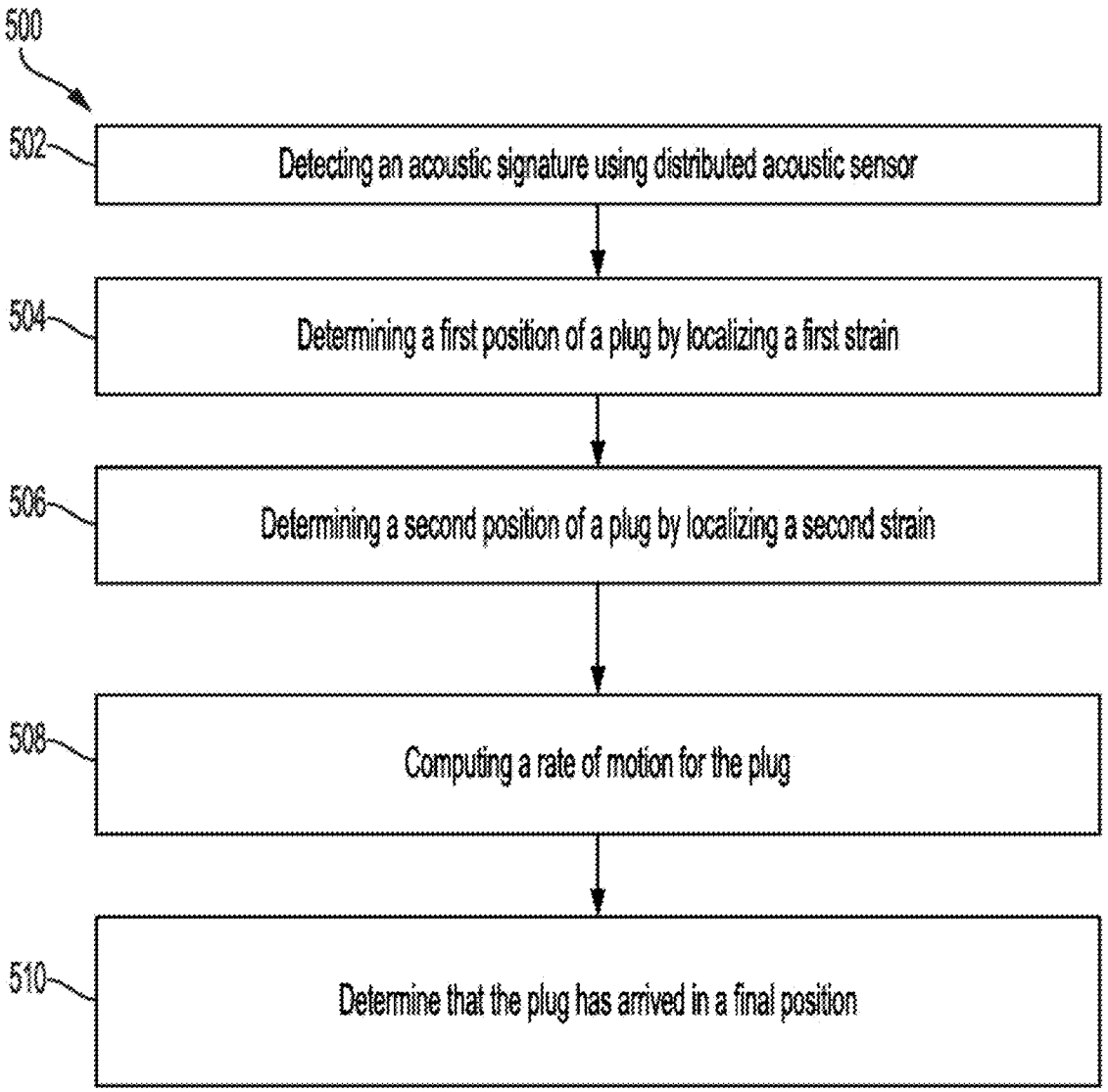
FIG. 5 depicts a process for determining a location of a downhole plug according to some aspect of the disclosure.

FIG. 5 is a flowchart of a process for determining a location of a plug according to some aspects of the disclosure.

At block 502, the process 500 involves detecting an acoustic signature using a distributed acoustic sensor. For example, a fiber optic cable 108 coupled to a completion section of casing 302 can experience phase differences caused by an acoustic event close to the fiber optic cable 108. A coherent optical time-domain reflectometer 115 may detect these variations and determine a particular acoustic signature of a downhole plug. The reflectometer 115 may communicate the variations to a computing device 116 in real-time.

At block 504, the process 500 involves determining a first position of a plug by localizing a first acoustic strain at a first time-step. For example, the distributed acoustic sensors (e.g., reflectometer 115 and fiber optic cable 108) can determine the detected acoustic signature is associated with a position of the plug within the wellbore. In one aspect, the first position may be determined by detecting the first acoustic strain that may be caused by interaction of the plug and the casing.

At block 506, the process 500 involves determining a second position of a plug by localizing a second strain at a second time-step in a similar manner as block 504. In one aspect, the second position may be determined by detecting a second acoustic strain that may be caused by interaction of the plug and the casing.

At block 508, the process 500 involves computing a rate of motion for the plug. For example, a time and distance can be computed between the first position and the second position and, accordingly, a rate of motion calculated. In some examples, the rate is displayed by the computing device or compared with an expected rate of motion. In one particular example, the computed rate of motion can differ from the expected rate by a threshold and provide an alert to a user of the computing device.

At block 510, the process involves determining that the plug has arrived in a final position. In one example, the final position could be the plug positioned adjacent to a landing collar or another plug.

Terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" or "comprising," when used in this specification, specify the presence of stated features, steps, operations, elements, or components, but do not preclude the presence or addition of one or more other features, steps, operations, elements, components, or groups thereof. Additionally, comparative, quantitative terms such as "above," "beneath," "less," and "greater" are intended to encompass the concept of equality, thus, "less" can mean not only "less" in the strictest mathematical sense, but also, "less than or equal to."

Unless specifically stated otherwise, it is appreciated that throughout this specification, that terms such as "processing," "calculating," "determining," "operations," or the like refer to actions or processes of a computing device, such as the controller or processing device described herein, that can manipulate or transform data represented as physical electronic or magnetic quantities within memories, registers, or other information storage devices, transmission devices, or display devices. The order of the process blocks presented in the examples above can be varied, for example, blocks can be re-ordered, combined, or broken into sub-blocks. Certain blocks or processes can be performed in parallel. The use of "configured to" herein is meant as open and inclusive language that does not foreclose devices configured to perform additional tasks or steps. Additionally, the use of "based on" is meant to be open and inclusive, in that a process, step, calculation, or other action "based on" one or more recited conditions or values may, in practice, be based on additional conditions or values beyond those recited.

Elements that are described as "connected," "connectable," or with similar terms can be connected directly or through intervening elements.

In some aspects, a system for using distributed acoustic sensors to track cement plugs is provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a well system comprising: a fiber optic cable positionable downhole along a length of a wellbore; a top plug positionable within a casing within the wellbore to drive a cement slurry in a downhole direction; and a reflectometer positionable to: inject optical signals into the fiber optic cable; receive reflected optical signals from the fiber optic cable; and determine a position of the top plug using the reflected optical signals indicating locations of acoustic strain in the fiber optic cable originating from interaction between the top plug and the casing.

Example 2 is the well system of example 1, wherein the reflectometer is a coherent optical time-domain reflectometer.

Example 3 is the well system of example 1, further comprising: a landing collar positionable within the casing; a bottom plug positionable within the casing between the top plug and the landing collar, wherein the cement slurry is positionable between the top plug and bottom plug; and a displacement fluid that is positionable between the top plug and a surface of the wellbore, wherein the displacement fluid is positionable to drive the top plug, the cement slurry, and the bottom plug toward the landing collar.

Example 4 is the well system of example 1, further comprising a computing system couplable to the reflectometer, wherein the computing system comprises a data acquisition system and visualization system to generate an output visualization of a real-time location of the top plug.

Example 5 is the well system of example 1, further comprising an additional fiber optic cable positionable downhole along the length of the wellbore, wherein the additional fiber optic cable is positionable at a separate azimuthal location around or inside the casing from the fiber optic cable.

Example 6 is the well system of example 1, wherein the top plug comprises one or more fins positionable to contact an interior surface of the casing and generate the acoustic strain as the top plug is run within the casing.

Example 7 is a method of determining a location of a cementing plug within a wellbore, the method comprising: determining, by a distributed acoustic sensor, a first location of the cementing plug within a casing within the wellbore at a first time step during a cementing operation; determining, by the distributed acoustic sensor, a second location of the cementing plug within a casing within the wellbore at a second time step during the cementing operation; and determining a rate of motion of the cementing plug during the cementing operation using the first location, the first time step, the second location, and the second time step.

Example 8 is the method of example 7, wherein the distributed acoustic sensor determines the first location by detecting a first localized strain on an optical fiber positionable along a length of the wellbore, and wherein the distributed acoustic sensor determines the second location by detecting a second localized strain on an optical fiber positionable along a length of the wellbore.

Example 9 is the method of examples 7 or 8, wherein the cementing plug comprises one or more fins, and wherein the first localized strain and the second localized strain are generated by contact of the one or more fins with the casing.

Example 10 is the method of examples 7 or 8, further comprising: generating a visualization of data associated with the location of the cementing plug by a computing system coupleable to the distributed acoustic sensor.

Example 11 is the method of examples 7 or 8, wherein the distributed acoustic sensor comprises a fiber optic cable and a reflectometer.

Example 12 is the method of example 11, wherein the reflectometer is a coherent time-domain reflectometer.

Example 13 is the method of example 11, wherein the distributed acoustic sensor further comprises an additional fiber optic cable coupled to the reflectometer.

Example 14 is a system for locating a downhole plug during a cementing operation, the system comprising: a distributed acoustic sensor comprising: a fiber optic cable positionable downhole within a wellbore; and a coherent optical time-domain reflectometer positionable to detect acoustic signals from the fiber optic cable; a top plug and a bottom plug positionable within a casing within the wellbore; and a computing device positionable to communicate with the coherent optical time-domain reflectometer, wherein the computing device comprises: a processor; and a non-transitory computer-readable medium that includes instructions that are executable by the processor to perform operations comprising: receiving a signal from the coherent optical time-domain reflectometer representing a localized strain at a first time within the wellbore resulting from contact between the top plug and the casing or the bottom plug and the casing; and determining a location of the top plug or the bottom plug based on the localized strain at the first time.

Example 15 is the system of example 14, wherein the top plug comprises a first set of fins positionable to interact with the casing, and wherein the bottom plug comprises a second set of fins positionable to interact with the casing.

Example 16 is the system of example 14, wherein the top plug comprises one or more fins that contact an interior surface of the casing to generate an acoustic strain that results in the localized strain at the distributed acoustic sensor as the top plug is run within the casing.

Example 17 is the system of example 14, wherein the bottom plug comprises one or more fins positionable to contact an interior surface of the casing and generate an acoustic strain as the bottom plug is run within the casing.

Example 18 is the system of example 14, wherein the operations further comprise: generating a visualization of data associated with a location of the top plug or the bottom plug.

Example 19 is the system of example 14, further comprising: a landing collar positionable within the casing; a cement slurry positionable between the top plug and bottom plug; and a displacement fluid that is positionable between the top plug and a surface of the wellbore, wherein the displacement fluid is injectable into the casing to drive the top plug, the cement slurry, and the bottom plug toward the landing collar.

Example 20 is the system of example 14, further comprising an additional fiber optic cable positionable downhole along a length of the wellbore, wherein the additional fiber optic cable is positionable at a separate azimuthal location around or inside the casing from the fiber optic cable.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A well system comprising:

a fiber optic cable positionable downhole along a length of an outer surface of a casing of a wellbore;

a top plug positionable within the casing within the wellbore to drive a cement slurry in a downhole direction; and a reflectometer positionable to:

inject optical signals into the fiber optic cable;

receive reflected optical signals from the fiber optic cable; and determine a position of the top plug using the reflected optical signals indicating locations of acoustic strain in the fiber optic cable originating from interaction between the top plug and the casing.

2. The well system of claim 1, wherein the reflectometer is a coherent optical time-domain reflectometer.

3. The well system of claim 1, further comprising:

a landing collar positionable within the casing;

a bottom plug positionable within the casing between the top plug and the landing collar, wherein the cement slurry is positionable between the top plug and bottom plug; and a displacement fluid that is positionable between the top plug and a surface of the wellbore, wherein the displacement fluid is positionable to drive the top plug, the cement slurry, and the bottom plug toward the landing collar.

4. The well system of claim 1, further comprising a computing system couplable to the reflectometer, wherein the computing system comprises a data acquisition system and visualization system to generate an output visualization of a real-time location of the top plug.

5. The well system of claim 1, further comprising an additional fiber optic cable positionable downhole along the length of the wellbore, wherein the additional fiber optic cable is positionable at a separate azimuthal location around or inside the casing from the fiber optic cable.

6. The well system of claim 1, wherein the top plug comprises one or more fins positionable to contact an interior surface of the casing and generate the acoustic strain as the top plug is run within the casing.

7. A method of determining a location of a cementing plug within a wellbore, the method comprising:

determining, by a distributed acoustic sensor, a first location of the cementing plug within a casing within the wellbore at a first time step during a cementing operation, wherein the distributed acoustic sensor determines the first location by detecting a first localized strain on an optical fiber positionable along a length of an outer surface of the casing of the wellbore;

determining, by the distributed acoustic sensor, a second location of the cementing plug within the casing within the wellbore at a second time step during the cementing operation, wherein the distributed acoustic sensor determines the second location by detecting a second localized strain on the optical fiber positionable along the length of the outer surface of the casing of the wellbore; and determining a rate of motion of the cementing plug during the cementing operation using the first location, the first time step, the second location, and the second time step.

8. The method of claim 7, further comprising:

comparing the rate of motion of the cementing plug during the cementing operation to a pumping velocity; and detecting a defect of the cementing plug based on a measured difference between the rate of motion of the cementing plug and the pumping velocity.

9. The method of claim 7, wherein the cementing plug comprises one or more fins, and wherein the first localized strain and the second localized strain are generated by contact of the one or more fins within the casing.

10. The method of claim 7, further comprising:

generating a visualization of data associated with the location of the cementing plug by a computing system coupleable to the distributed acoustic sensor.

11. The method of claim 10, wherein the distributed acoustic sensor comprises a fiber optic cable and a reflectometer.

12. The method of claim 11, wherein the distributed acoustic sensor further comprises an additional fiber optic cable coupled to the reflectometer.

13. A system for locating a downhole plug during a cementing operation, the system comprising:

a distributed acoustic sensor comprising:

a fiber optic cable positionable downhole along a length of an outer surface of a casing of a wellbore; and a coherent optical time-domain reflectometer positionable to detect acoustic signals from the fiber optic cable;

a top plug and a bottom plug positionable within the casing within the wellbore; and a computing device positionable to communicate with the coherent optical time-domain reflectometer, wherein the computing device comprises:

a processor; and a non-transitory computer-readable medium that includes instructions that are executable by the processor to perform operations comprising:

receiving a signal from the coherent optical time-domain reflectometer representing a localized strain at a first time within the wellbore resulting from contact between the top plug and the casing or the bottom plug and the casing; and determining a location of the top plug or the bottom plug based on the localized strain at the first time.

14. The system of claim 13, further comprising an additional fiber optic cable positionable downhole along a length of the wellbore, wherein the additional fiber optic cable is positionable at a separate azimuthal location around or inside the casing from the fiber optic cable.

15. The system of claim 13, wherein the top plug comprises a first set of fins positionable to interact with the casing, and wherein the bottom plug comprises a second set of fins positionable to interact with the casing.

16. The system of claim 13, wherein the top plug comprises one or more fins that contact an interior surface of the casing to generate an acoustic strain that results in the localized strain at the distributed acoustic sensor as the top plug is run within the casing.

17. The system of claim 13, wherein the bottom plug comprises one or more fins positionable to contact an interior surface of the casing and generate an acoustic strain as the bottom plug is run within the casing.

18. The system of claim 13, wherein the operations further comprise:

generating a visualization of data associated with a location of the top plug or the bottom plug.

19. The system of claim 13, further comprising:

a landing collar positionable within the casing;

a cement slurry positionable between the top plug and the bottom plug; and a displacement fluid that is positionable between the top plug and a surface of the wellbore, wherein the displacement fluid is injectable into the casing to drive the top plug, the cement slurry, and the bottom plug toward the landing collar.

* * * * *